US005117527A

United States Patent [19]

Milkie

[11] Patent Number: 5,117,527

[45] Date of Patent: Jun. 2, 1992

[54] PAINT APPLICATOR

[76] Inventor: Terry H. Milkie, 3 Burtree Dr., Brampton, Ontario, Canada, L6Z 3K3

[21] Appl. No.: 683,842

[22] Filed: Apr. 3, 1991

[51] Int. Cl.[5] ..... A46B 15/00; B05C 17/00

[52] U.S. Cl. ..... 15/210 R; 118/207; 118/264

[58] Field of Search ..... 118/264, 207; 15/210 R, 15/209 R, 244.1, 145; 401/266

[56] References Cited

U.S. PATENT DOCUMENTS

| | | | |
|---|---|---|---|
| 2,810,148 | 10/1957 | Wood, Jr. | 118/207 |
| 3,359,589 | 12/1967 | Moore | 15/210 R |
| 3,605,165 | 9/1971 | Burns | 15/210 R |
| 3,708,821 | 1/1973 | Chase et al. | 15/210 R |

*Primary Examiner*—Michael G. Wityshyn
*Attorney, Agent, or Firm*—Smart & Biggar

[57] ABSTRACT

A paint applicator comprises a frame with a flat side which carries an absorbent pad; the other side of the frame supports a handle. The axles for a pair of rollers depend from a hinged mount supported on the handled face of said frame; the axles are parallel and are inclined toward one margin of the frame. The angle of the hinged mount with respect to the frame is adjustable. The rolling face of each of the rollers have a circumferential groove and the edge of the rolling distal from the frame has a circumferential flat surface which converges toward the axle of the roller in a direction away from the frame. The applicator may be used to edge the paint on a surface adjacent a narrow moulding with a bevelled corner by positioning the applicator so that the pad is against the edge of the surface with the grooved rolling face cupping the bevelled edge of the moulding. The incline of the rollers may need to be adjusted to achieve this. The applicator may then be moved along the edge of the first surface with the rollers rolling on the bevelled edge. With a wide moulding, the flat surface of the rolling face of the rollers abuts the moulding and, again, the applicator may then be moved along the edge of the surface. In another embodiment the roller axle mount is a fixed angle with respect to the frame.

10 Claims, 6 Drawing Sheets

PAINT APPLICATOR

BACKGROUND OF THE INVENTION

1. Field of the Invention

This invention relates to a paint applicator for applying paint to the edge of a first surface which forms an inside corner with a second surface.

2. Description of the Related Art

U.S. Pat. No. 2,810,148 issued Oct. 22, 1957 to Wood, Jr. describes an applicator for applying paint at the edge of a surface which forms an inside corner with a perpendicular locating surface. The applicator comprises a frame with a flat side which carries an absorbent pad; the other side of the frame supports a handle. Two spaced rollers with axes of rotation perpendicular to the flat side of the frame are fixed to the frame so as to project below its base. The applicator may then be positioned so that the pad is against the surface to be painted with the rollers resting on the locating surface and the applicator may then be moved along the edge of the surface to be painted with the rollers rolling on the locating surface. In this way the locating surface locates the applicator so that paint may be applied to the edge of the surface to be painted closely adjacent the locating surface.

In a known modification of the applicator of the Wood, Jr. patent, the rollers are mounted on a support which is in turn mounted to the frame and may be adjusted to adjust the extent to which the rollers project beyond the base of the frame.

A problem arises where the adjacent locating surface is narrower than the distance between the rollers and the absorbent pad or where the locating surface slopes. In such circumstances the rollers of the known applicators may fail to obtain a purchase on the locating surface.

This invention seeks to overcome drawbacks of known paint applicators.

SUMMARY OF THE INVENTION

According to the present invention, there is provided a paint applicator for applying paint to the edge of a first surface which forms an inside corner with a second surface, comprising the following: a frame having a flat face for carrying a paint absorbent pad; a handle on the face of said frame opposite said flat face; a pair of rollers spaced along the handled face of said frame having generally parallel axes of rotation inclined toward one margin of said frame such that said rollers project beyond said margin of said frame, the rolling face of each of said rollers having a circumferential groove, whereby when a paint absorbent pad carried by said frame abuts the edge of a first surface which forms an inside corner with a second surface, the grooved rolling face of each of said rollers may cup a corner of said second surface to thereby support said absorbent pad in spaced relation to said second surface.

BRIEF DESCRIPTION OF THE DRAWINGS

In the figures which disclose example embodiments of the invention.

DESCRIPTION OF THE PREFERRED EMBODIMENTS

Figure 1:
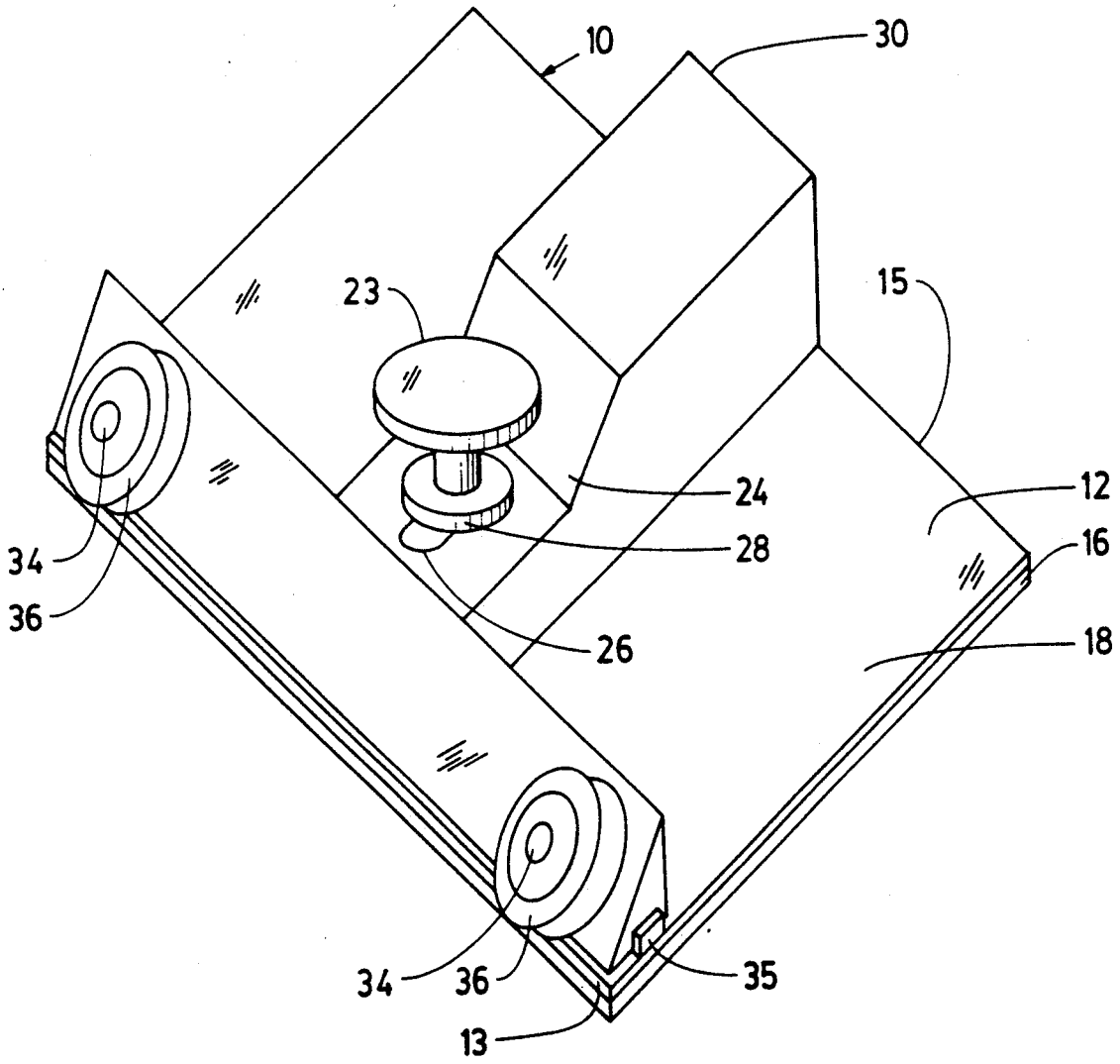
FIG. 1 is a perspective view of a paint applicator made in accordance with this invention.
Figure 2:
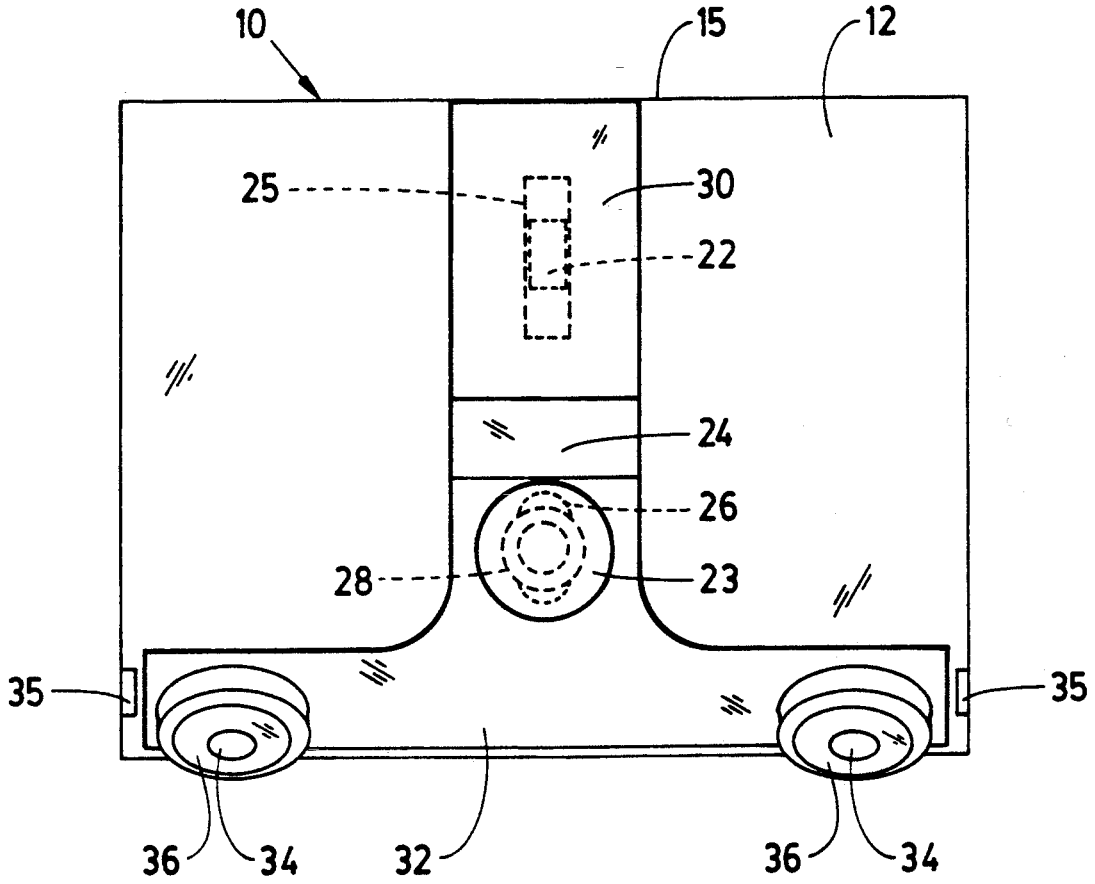
FIG. 2 is a back view of the applicator of FIG. 1.
Figure 3:
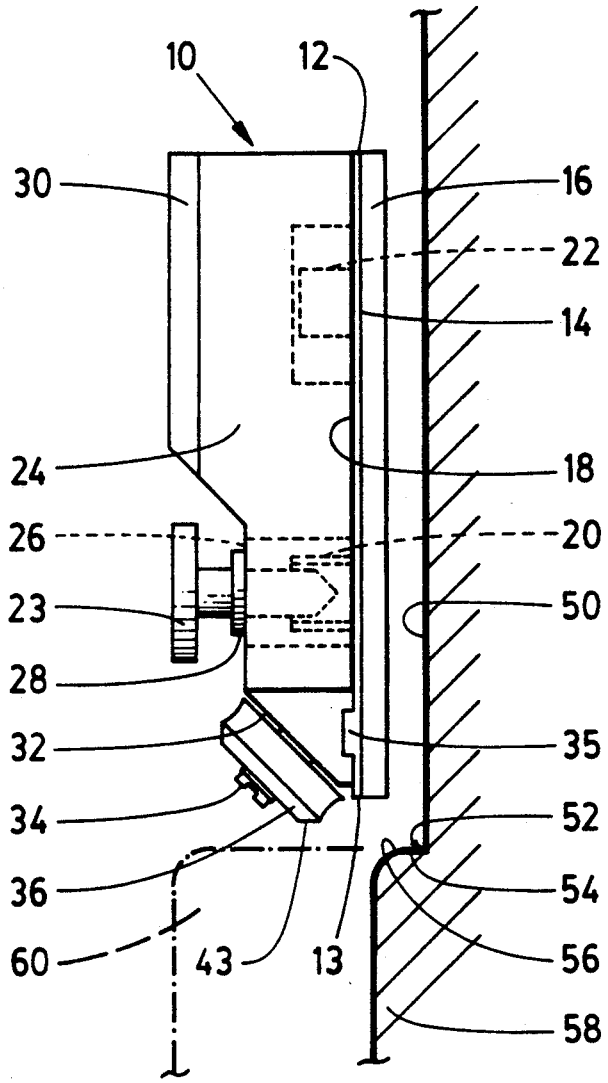
FIG. 3 is a side view of the applicator of FIG. 1 showing the applicator proximate a surface to be painted.

With reference to FIGS. 1 through 3, a paint applicator 10 comprises a frame 12 having a top margin 15, a bottom margin 13, a flat front face 14, and a back face 18. The flat front face supports a paint absorbent pad 16. The back face 18 of the frame has an internally threaded cylinder 20 and a guide 22 projecting therefrom. A support 24 is clamped to back face 18 of the frame 12 by a shouldered bolt 23 which passes through elongate opening 26 in the support and is threaded to internally threaded cylinder 20 of the frame until shoulder 28 of the bolt abuts the support. An elongate opening 25 in the support receives guide 22 of the frame in order to align the support on the frame. The support has a handle 30 and a basal oblique face 32 from which two laterally spaced parallel axles 34 project normally. Due to the slope of oblique face 32, the two axles 34 are inclined toward the bottom margin 13 of the frame. Preferably, the angle of the oblique face is such that the axles make an angle of about forty-five degrees with the front face 14 of the frame. Each axle carries a roller 36 so that the rollers are spaced laterally along the handle side of the frame. The rollers project below the bottom margin 13 of the frame.

The vertical position of the support on the frame 12, and hence the distance the rollers project below the base margin 13 of the frame, may be adjusted by loosening bolt 23 and sliding the support up or down. The limit of the vertical adjustment is determined by the bolt contacting one of the ends of the elongate slot 26.

Figure 4:
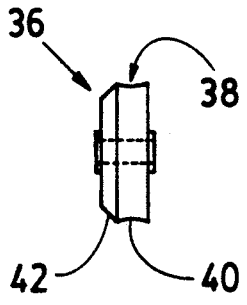
FIG. 4 is an end view of a roller used in the applicator of FIG. 1.

With reference to FIG. 4 as well as FIG. 3, the rolling face 38 of each roller 36 includes a circumferential groove 40. As well, the edge of rolling face 38 distal from the oblique surface 32 (and, hence, distal from the frame) has a circumferential flat surface 42 which converges toward the axle of the roller in a direction away from the oblique surface 32. The angle of incline of axle 34 and the convergence of flat surface 42 is chosen so that the lowermost portion 43 of flat surface 42 of each roller is perpendicular to the flat front face 14 of the frame 12.

Figure 5:
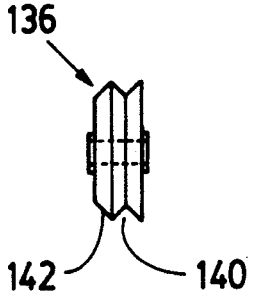
FIG. 5 is an end view of an alternate embodiment of a roller which may be used with the applicator of FIG. 1.
Figure 6:
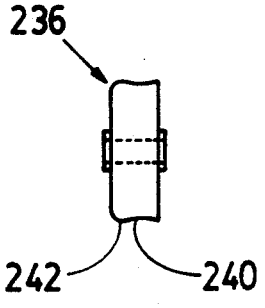
FIG. 6 is an end view of another embodiment of a roller which may be used with the applicator of FIG. 1.

FIG. 5 illustrates an alternate embodiment for the roller. With reference to FIG. 5, the circumferential groove 140 on the rolling face of roller 136 is angulated. The flat surface 142 on the rolling face is similar to the flat surface 42 of the roller 36 of FIG. 4. FIG. 6 illustrates a further alternate embodiment for the roller. Referring to FIG. 6, the rolling face of roller 236 has a circumferential groove 240 similar to the circumferential groove of the roller of FIG. 4. However, the edge of the rolling face comprising flat surface 42 of the roller of FIG. 4 has been replaced with a bevelled edge 242.

The paint absorbent pad 16 may be affixed to the flat front face 14 of frame 12 by any suitable means, such as an adhesive backing on the pad. In order to accommodate one known style of pad which terminates at either side in resilient plastic hooks intended to snap over the side margins of the back face 18 of the applicator 10, stops 35 protrude from the back face 18 provide an abutment surface for these hooks in order to locate such a pad on the applicator.

With reference to FIG. 3, the paint applicator 10 is for use in applying paint to the edge of a surface 50 which forms an inside corner 52 with a second, locating, surface 54. The locating surface 54 may be the top surface of a narrow moulding 58 having a bevelled corner 56. In such instance, in use, the applicator is positioned in abutment with the edge of surface 50 with the grooved portion 40 of the rolling face 38 of rollers 36 cupping bevelled corner 56 of moulding 58. The rollers thereby support the absorbent pad just above the surface 54 of the moulding. The applicator may then be moved from side to side with the rollers rolling along the bevelled corner of the moulding in order to apply paint along the edge of surface 50. It will be seen that the rollers of the applicator may be supported on a very narrow moulding due to the incline of the rollers toward the moulding.

The grooved portion of the rolling face will cup the bevelled corner, and hence support the applicator, where the slope of the bevelled corner either matches, or is steeper than that of the grooved portion of the rolling face. Hence a close match to the profile of the bevelled corner is not necessary. Where corner 56 of narrow moulding 58 is angulated, better support may be obtained with the roller of FIG. 5 with its angulated grooved surface 140.

Where the moulding is wide, such as is illustrated in phantom at 60 in FIG. 3, surface 54 of the moulding—which is perpendicular to surface 50—will project past the grooved surface 40 of the rollers. Since the front face 14 of the applicator will be parallel to surface 50 and the lowermost portion 43 of the rollers is perpendicular to the front face 14, the lowermost portion 43 will be parallel with, and will contact, the surface 54 of the moulding. Once again, the applicator may then be moved from side to side with the rollers rolling along surface 54 of the moulding in order to apply paint along the edge of surface 50.

Where the rollers 236 of FIG. 6 are substituted for the rollers of FIG. 4 and the moulding is wide, the bevelled corner 242 of the roller contacts surface 54 of the moulding. Rollers 236 are better suited to applications where surface 54 of the moulding is not exactly perpendicular to surface 50.

Figure 7:
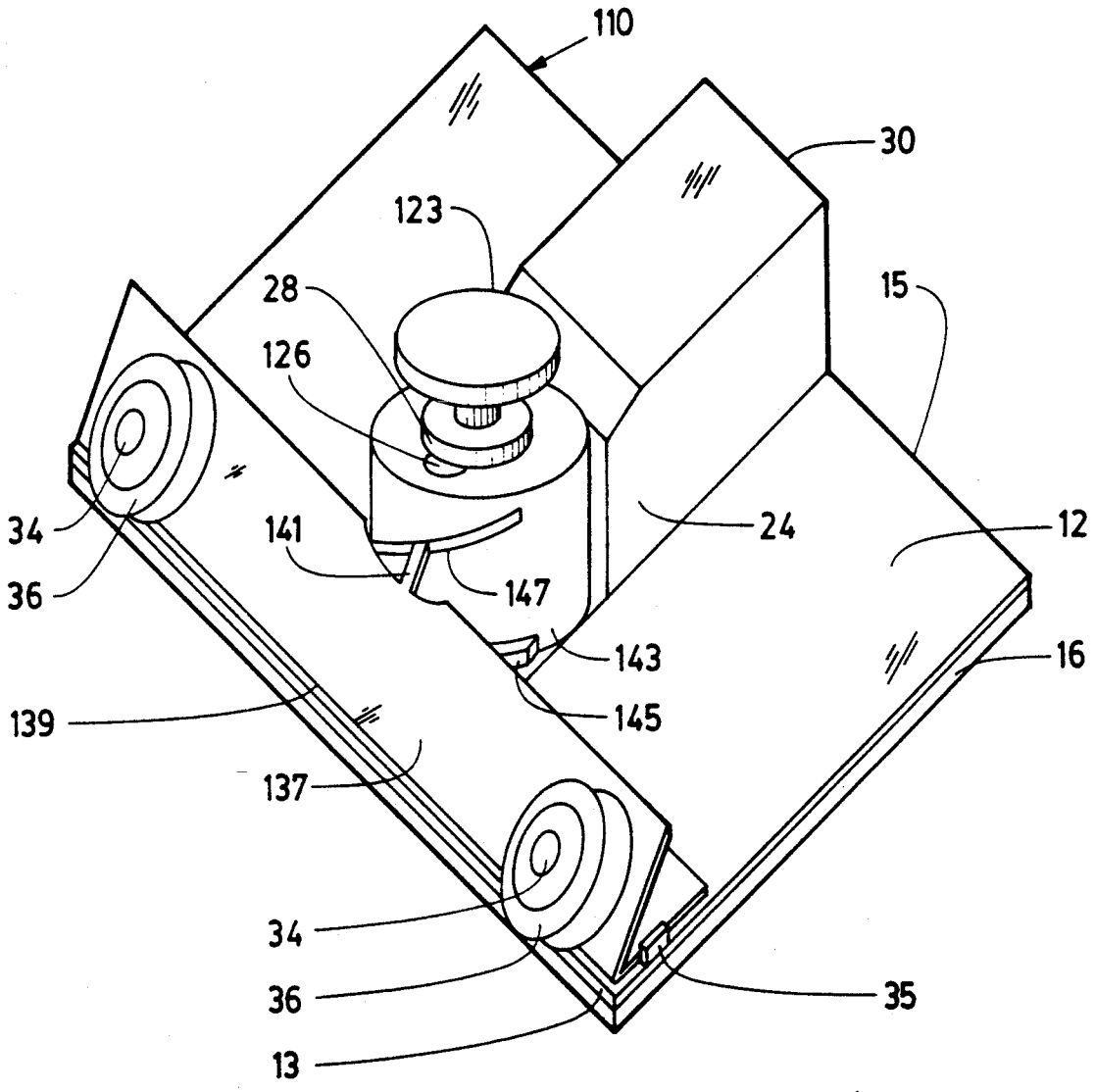
FIG. 7 is a perspective view of an alternate embodiment of a paint applicator made in accordance with this invention.
Figure 8:
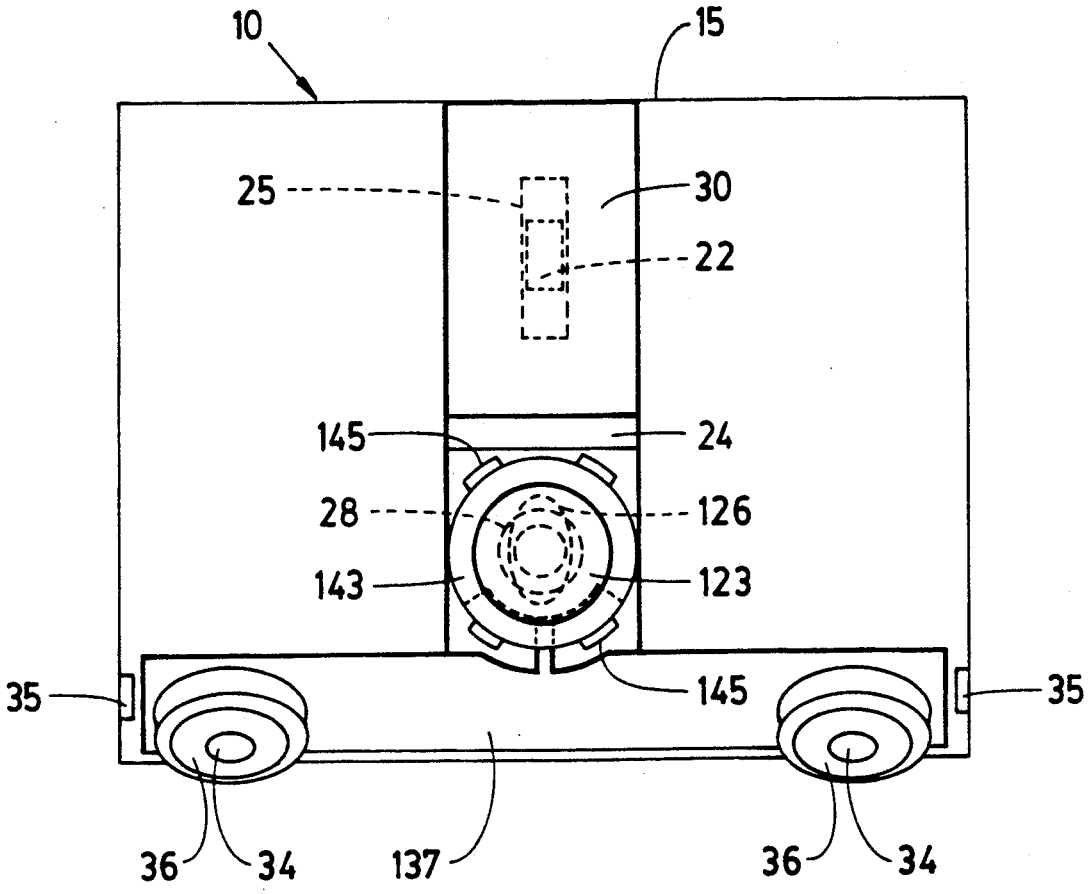
FIG. 8 is a back view of the applicator of FIG. 7.
Figure 9:
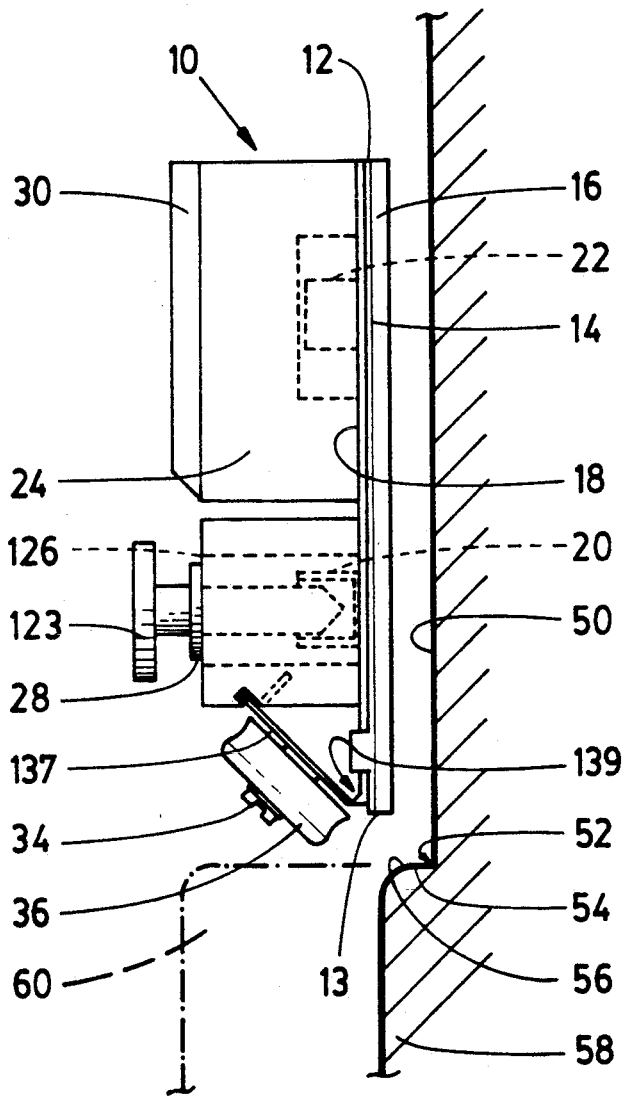
FIG. 9 is a side view of the applicator of FIG. 7 showing the applicator proximate a surface to be painted.

FIGS. 7 through 9 illustrate an alternate embodiment for the paint applicator of this invention. Turning to these figures, wherein like parts have been designated with like reference numerals, the paint applicator 110 comprises hinged mount 137 which is connected to support 24 at hinge 139. As shown, hinge 139 is a reduced width resilient margin along the edge of the hinged piece 137 such that the hinged piece 137 is integrally formed with the support 24. The roller axles 34 are mounted to the hinged mount. A tag 141 extends from the hinged mount.

A cylinder 143 is located on support 24 by arcuate supports 145. The cylinder has an elongated through bore 126; a slot 147 extends along the side of the cylinder and is angled such that one end of the slot is proximate the top of the cylinder and the other end of the slot is proximate the middle of the cylinder. Bolt 123 extends through the bore 126 of the cylinder and threads into the internally threaded cylinder 20 which projects from the back face 18 of the frame. The bolt may be turned to snug the shoulder 28 of the bolt against the cylinder in order to hold the cylinder from rotating and to prevent movement of the support 24 with respect to the frame 12. It will be noted that the lateral extent of the bore 126 is greater than diameter of the bolt 23. The tag 141 of the hinged mount is received by the slot 147 of the cylinder 143.

In use of the applicator of FIGS. 7 through 9, bolt 23 may be loosed, freeing support 24 to slide so as to extend or retract the rollers 36 with respect to the base 13 of the frame, limited only by bolt 23 contacting the edge of through bore 126. Furthermore, with the bolt loosed, arcuate supports 145 permit cylinder 143 to rotate about its longitudinal axis. However, rotation of cylinder 143 registers different portions of slot 147 with tag 141. Consequently, due to the angle of the slot, rotation of the cylinder changes the angle of the hinged mount with respect to the frame. Once the rollers 36 have been moved a desired amount below base 13 of the frame and the hinged mount has been tilted to a desired angle, the bolt may again be snugged against the cylinder 143 to lock the cylinder 143 against rotation and the support 24 against sliding. Because the lateral extent of the through bore 126 is greater than the diameter of the bolt 123, the cylinder has freedom to rotate when its axis of rotation (which passes through the centre of the through bore) is not concentric with the longitudinal axis of the bolt.

The ability to adjust the angle of the hinged mount 137, and hence the angle of incline of the roller axles 34 toward the base of the frame, makes the applicator of FIGS. 7 through 9 more versatile than the applicator of FIGS. 1 through 3. That is, this applicator may be used with a wider variety of moulding geometries.

Other modifications will be apparent to those skilled in the art and, accordingly, the invention is defined in the claims.

What is claimed is:

1. A paint applicator for applying paint to the edge of a first surface which forms an inside corner with a second surface, comprising the following:

a frame having a flat face for carrying a paint absorbent pad;

a handle on the face of said frame opposite said flat face;

a pair of rollers spaced along the handled face of said frame having generally parallel axes of rotation inclined toward one margin of said frame such that said rollers project beyond said margin of said frame, the rolling face of each of said rollers having a circumferential groove, whereby, when a paint absorbent pad carried by said frame abuts the edge of a first surface which forms an inside corner with a second surface, the grooved rolling face of each of said rollers may cup a corner of said second surface to thereby support said absorbent pad in spaced relation to said second surface.

2. The paint applicator of claim 1 wherein said rollers are carried by a mount which is hingedly supported by said frame proximate said one margin of said frame and including means to lock said mount at selected angles with respect to said frame whereby the incline of said axes of rotation toward said one margin of said frame may be adjusted.

3. The paint applicator of claim 2 wherein said rollers are mounted on a support and said support is adjustably mounted on said frame so that the distance said rollers project below said margin of said frame may be adjusted.

4. The paint applicator of claim 1 wherein the incline of said axes of rotation is fixed such that each of said axes of rotation makes about a 45 degree angle with said flat face of said frame.

5. The paint applicator of claim 1 wherein said rolling face of each of said rollers includes a circumferential flat surface at the edge of said rolling face distal from said frame, said flat face being convergent toward the axis of rotation of said roller in a direction away from said frame, whereby, when a paint absorbent pad carried by said frame abuts the edge of a first surface which forms an inside corner with a second surface which is perpendicular to said first surface, the flat rolling surface of each of said rollers may abut said second surface to thereby support said absorbent pad in spaced relation to said second surface.

6. A paint applicator for applying paint to the edge of a surface which forms an inside corner with a moulding, comprising the following:

a frame having a flat side for carrying a paint absorbent pad;

a handle on the side of said frame opposite said flat side;

a pair of parallel spaced rollers depending from the handle side of said frame having generally parallel axes of rotation inclined toward one margin of said frame such that said rollers project beyond said margin of said frame, the rolling face of each of said rollers having a circumferential groove, whereby, when a paint absorbent pad carried by said frame abuts the edge of a surface which forms an inside corner with a narrow moulding having a bevelled corner, the grooved rolling face of each of said rollers may cup said bevelled corner of said moulding to thereby support said absorbent pad in spaced relation to said moulding.

7. The paint applicator of claim 6 wherein said rollers are mounted on a support and said support is adjustably mounted on said frame so that the distance said rollers project below said margin of said frame may be adjusted.

8. The paint applicator of claim 6 wherein the incline of said axes of rotation is fixed such that each of said axes of rotation makes about a 45 degree angle with said flat face of said frame.

9. The paint applicator of claim 6 wherein said rollers are carried by a mount which is hingedly supported by said frame proximate said one margin of said frame and including means to lock said mount at selected angles with respect to said frame whereby the incline of said axes of rotation toward said one margin of said frame may be adjusted.

10. The paint applicator of claim 6 wherein said rolling face of each of said rollers includes a circumferential flat surface at the edge of said rolling face distal from said frame, said flat face being convergent toward the axis of rotation of said roller in a direction away from said frame, whereby, when a paint absorbent pad carried by said frame abuts the edge of a surface which forms an inside corner with a wide moulding which has a moulding surface perpendicular to said surface, the flat rolling surface of each of said rollers may abut said moulding surface to thereby support said absorbent pad in spaced relation to said moulding.

* * * * *